US011731805B2

(12) United States Patent
Bisinger

(10) Patent No.: US 11,731,805 B2
(45) Date of Patent: Aug. 22, 2023

(54) COLLAPSIBLE CONTAINERS INCLUDING ATTACHMENT BRACKETS

(71) Applicant: PRO blanket bars GmbH, Bisingen (DE)

(72) Inventor: Timo Bisinger, Geislingen (DE)

(73) Assignee: PRO blanket bars GmbH, Bisingen (DE)

( * ) Notice: Subject to any disclaimer, the term of this patent is extended or adjusted under 35 U.S.C. 154(b) by 384 days.

(21) Appl. No.: 17/155,683

(22) Filed: Jan. 22, 2021

(65) Prior Publication Data

US 2022/0234783 A1 Jul. 28, 2022

(51) Int. Cl.
*B65D 19/16* (2006.01)
*B65D 19/12* (2006.01)

(52) U.S. Cl.
CPC ..... *B65D 19/16* (2013.01); *B65D 19/12* (2013.01); *B65D 2519/00024* (2013.01); *B65D 2519/00029* (2013.01); *B65D 2519/00164* (2013.01); *B65D 2519/00169* (2013.01); *B65D 2519/00273* (2013.01); *B65D 2519/00611* (2013.01); *B65D 2519/00875* (2013.01)

(58) Field of Classification Search
CPC ..... B65D 19/16; B65D 19/12; B65D 2519/00024; B65D 2519/00029; B65D 2519/00164; B65D 2519/00169; B65D 2519/00273; B65D 2519/00611; B65D 2519/00875
USPC ..... 220/4.33, 4.34, 7
See application file for complete search history.

(56) References Cited

U.S. PATENT DOCUMENTS

| | | | | |
|---|---|---|---|---|
| 3,266,656 | A | 8/1966 | Kridle | |
| 3,989,156 | A | 11/1976 | Lowry | |
| 4,024,977 | A | 5/1977 | Rowley | |
| 4,796,392 | A * | 1/1989 | Graham, Jr. | B65D 90/08 217/61 |
| 5,114,194 | A | 5/1992 | Toifl et al. | |
| 5,253,763 | A | 10/1993 | Kirkley et al. | |
| 5,555,980 | A | 9/1996 | Johnston et al. | |
| 5,597,084 | A * | 1/1997 | Parasin | B65D 19/18 220/4.28 |
| 5,722,551 | A | 3/1998 | Cocciemiglio, Jr. | |
| 6,315,495 | B1 * | 11/2001 | Starheim | E21B 21/01 405/129.75 |
| 6,443,508 | B1 | 9/2002 | Persson | |
| 6,749,077 | B1 * | 6/2004 | McAlpine | B65D 11/1833 220/4.33 |
| 6,799,691 | B2 | 10/2004 | Wincent | |
| 7,428,973 | B2 * | 9/2008 | Barth | B65D 11/1833 220/7 |
| 7,552,826 | B2 | 6/2009 | Watanabe | |
| 7,753,222 | B1 | 7/2010 | Heinrichs | |

(Continued)

FOREIGN PATENT DOCUMENTS

EP 0455875 B1 3/1995

*Primary Examiner* — Jacob K Ackun
(74) *Attorney, Agent, or Firm* — Andrus Intellectual Property Law, LLP

(57) ABSTRACT

A container includes a first panel with a detent and a pin extending therefrom, a second panel that extends transverse to the first panel, and a bracket removably coupled to the first panel via engagement with the detent and the pin such that the bracket prevents movement of the second panel relative to the first panel. The detent is selectively depressed to thereby decouple the bracket from the first panel.

21 Claims, 8 Drawing Sheets

(56) References Cited

U.S. PATENT DOCUMENTS

| | | | | |
|---|---|---|---|---|
| 8,028,849 | B2 * | 10/2011 | Hall | B65D 19/16 220/4.33 |
| 8,083,448 | B2 | 12/2011 | Heinrichs et al. | |
| 8,672,137 | B2 | 3/2014 | Seagle et al. | |
| 8,708,178 | B2 | 4/2014 | Kvols et al. | |
| 8,813,985 | B2 | 8/2014 | Schloesser | |
| 10,060,455 | B2 | 8/2018 | Munch-Fals | |
| 2002/0139798 | A1 | 10/2002 | Logan et al. | |
| 2004/0208689 | A1 | 10/2004 | Dijkstra | |
| 2006/0226143 | A1 * | 10/2006 | Elstone, Sr. | B65D 19/12 220/6 |
| 2011/0194893 | A1 | 8/2011 | Wiebe | |
| 2013/0315652 | A1 | 11/2013 | Eding | |
| 2014/0110404 | A1 * | 4/2014 | Wiebe | B65D 21/0204 220/4.33 |
| 2016/0195118 | A1 | 7/2016 | Munch-Fals et al. | |

* cited by examiner

COLLAPSIBLE CONTAINERS INCLUDING ATTACHMENT BRACKETS

FIELD

The present disclosure relates to containers used for shipping cargo and specifically to collapsible and reusable containers.

BACKGROUND

Collapsible containers are commonly used in the shipping industry to transport cargo. Collapsible containers may be reused to reduce waste disposal costs associated with "single-use" shipping containers. Furthermore, collapsible containers may reduce storage space necessary when the containers are not in use.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a container includes a first panel with a detent and a pin extending therefrom, a second panel that extends transverse to the first panel, and a bracket removably coupled to the first panel via engagement with the detent and the pin such that the bracket prevents movement of the second panel relative to the first panel. The detent is selectively depressed to thereby decouple the bracket from the first panel.

In certain examples, a container includes a first panel with a detent, a first pin, and a second pin extending therefrom and a second panel that extends transverse to the first panel. A bracket is removably coupled to the first panel via engagement with the detent, the first pin, and the second pin such that a first arm of the bracket is coupled to the first panel and a second arm of the bracket extends along the second panel to thereby prevent movement of the second panel relative to the first panel. The detent is selectively depressed to thereby decouple the bracket from the first panel.

In certain examples, a method for assembling a container includes the steps of positioning a first panel adjacent to the second panel, wherein the first panel has a pin and a detent, positioning a bracket with a slot along the first panel such that the pin is in the slot and the bracket depresses the detent, and moving the bracket relative to the first panel such that the pin is in a leg of the slot and the detent automatically extends into the slot such that the bracket is fixed relative to the first panel.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
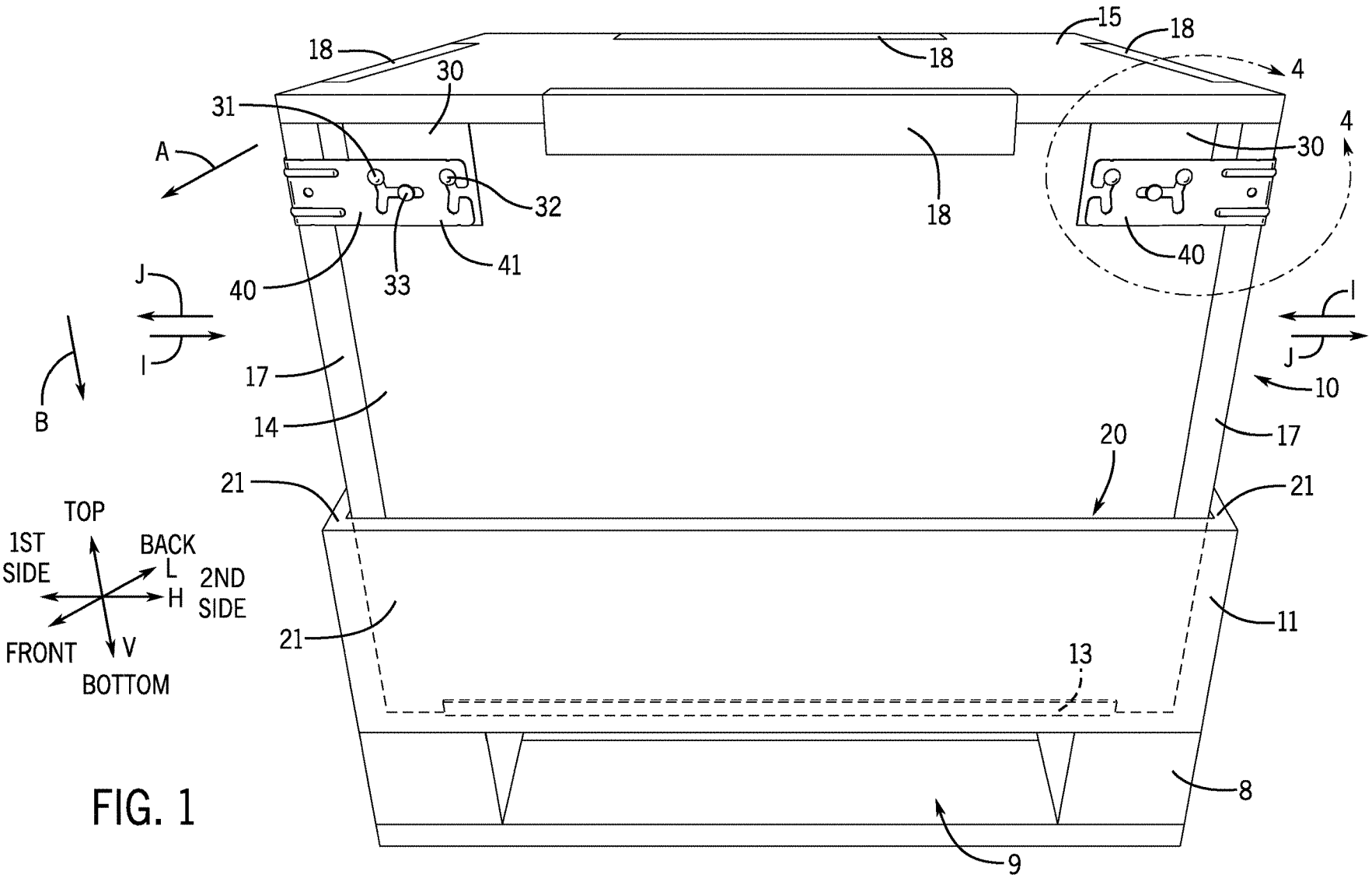
FIG. 1 is a perspective view of an example container with panels assembled on a base and brackets securing the panels to each other.
Figure 2:
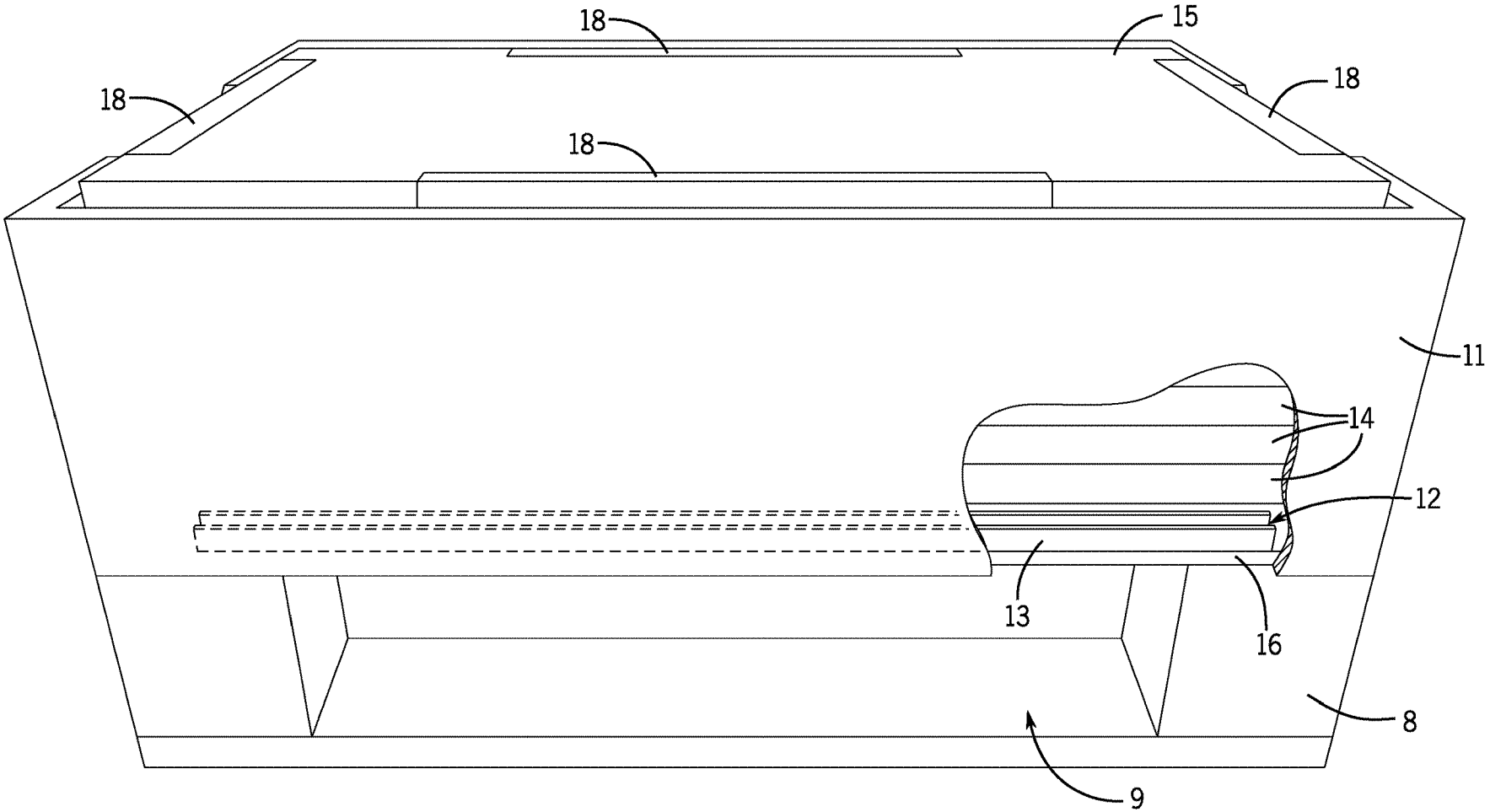
FIG. 2 is a perspective view of an example container system with panels stacked in the base.

FIGS. 1-2 depict an example container 10 of the present disclosure in which cargo is received. As depicted in FIG. 1, the container 10 is formed by a plurality of panels 14, 15, 16 that are on a base 11. The container 10 defines an internal cavity 23 (FIG. 4) in which cargo is contained. Note that the container 10 generally extends along a vertical axis (see arrow V) between a top and a bottom, a lateral axis (see arrow H) between a front and a back, and a longitudinal axis (see arrow L) between a first side and an opposite second side. The containers 10 are formed by any suitable material such as metal, plywood, corrugated cardboard, and solid wood.

Also note that although FIG. 1 depicts only one side panel 14 and a top panel 15, the container 10 includes additional side panels 14 (see FIG. 4) and a bottom panel 16 (see FIG. 2). The shape of the container 10 can vary, and in one example, the container 10 has a total of four side panels 14 such that the container 10 has a generally a rectangular prism.

The side panels 14 have edge guards 17 that protect the ends and edges of the side panels 14. The edge guards 17 are coupled to the side panels 14 with adhesives or fasteners such as screws. The edge guards 17 are L-shaped or U-shaped and are formed of any suitable material such as metal and plastic.

Each side panel 14 can also include one or more mounting plates 30 that each include a first pin 31, a second pin 32, and a detent 33 extending therefrom. The mounting plates 30 are on an exterior surface of the side panel 14 that is opposite an interior surface that faces an internal cavity 23 (FIG. 4) formed by the container 10. As such, the first pin 31, the second pin 32, and the detent 33 extend outwardly in a forward or first direction (see arrow A) away from the exterior surface of the container 10. Each pin 31, 32 has a pinhead 35 and a shaft 36 (FIG. 12) that extends between the mounting plate 30 and the pinhead 35. The pinhead 35 is enlarged relative to the cross-section or diameter of the shaft 36. The pins 31, 32 are aligned with each other in the lateral direction and the detent 33 is offset from the pins 31, 32 (e.g., the pins 31, 32 are positioned along a common line and the detent 33 is not positioned along the common line). For instance, the detent 33 is vertically offset from pins 31, 32. In certain examples, the pins 31, 32 are fixed on the side panel 14. In certain examples, the number of pins can vary (e.g., only one pin extends from the mounting plate, four pins extend from the mounting plate).

Figure 4:
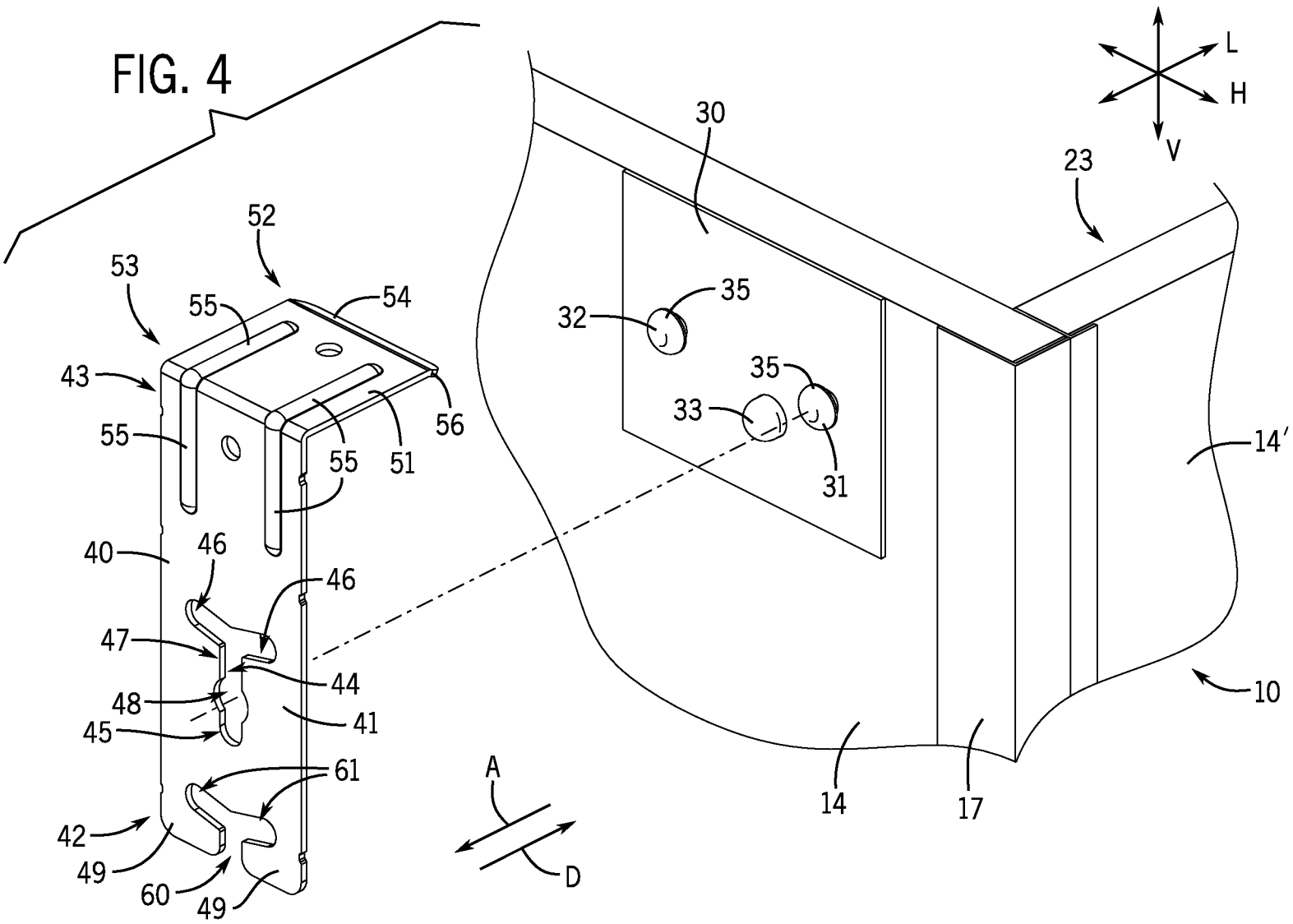
FIGS. 4-12 are various views depicting a sequence for coupling the bracket to panels of the container system. Note that FIG. 6 is a cross-sectional view of the bracket and the panel along line 6-6 on FIG. 5 and FIGS. 11-12 are cross-sectional views of the bracket and the panel along lines 11-11 and 12-12, respectively, on FIG. 10.

The number of mounting plates 30 on each side panel 14 can vary, and in one example, two mounting plates 30 are coupled to the top portions of two opposing side panels 14. Note that in certain examples, the pins 31, 32 and the detent 33 are coupled directly to the exterior surface of the side panel 14 such that the mounting plate 30 can be excluded. Brackets 40 (described further herein) are coupled to each mounting plate 30 to thereby prevent movement of adjacent side panels 14 (described further herein) and/or secure the shape of the container 10. In one example, the brackets 40 prevent movement of the side panels 14 in an outward direction (see arrows J on FIG. 1) relative to the center of the internal cavity 23 (FIG. 4).

The top panel 15 rests on top of the side panels 14 and defines the top of the container 10. The top panel 15 has one or more lips 18 that extend from the sides or edges of the top panel 15. Thus, when the top panel 15 is placed on top of the side panels 14, the lips 18 extend in a second or downward direction (see arrow B on FIG. 1) and along the exterior surfaces of the side panels 14. Therefore, the lips 18 prevent the top portions of the side panels 14 from bowing outwardly. The lips 18 are coupled to the top panels 15 with adhesives or fasteners such as screws. The lips 18 are L-shaped and formed with any suitable material such as metal and plastic.

The bottom panel 16 (FIG. 2) rests on the base 11 and has a plurality of channels 12 that receive bottom ends of the side panels 14. Accordingly, the side panels 14 are prevented from inwardly moving or bowing. That is, when the side panels 14 are in the channels 12, the side panels do not move in an inward direction (see arrow I on FIG. 1) relative to the center of the internal cavity 23 (FIG. 4). The bottom panel 16 defines the bottom of the container 10 and the side panels 14 are vertically supported when the side panels 14 are in the channels 12. The channels 12 are defined U-shaped support members 13 that vertically upwardly extend toward the top of the container 10. In other examples, the channels 12 are recessed in the bottom panel 16.

The bottom panel 16 rests on the base 11, and thus, the container 10 rests on the base 11 when constructed. The base 11 has a recessed chamber 20 in which the container 10 sits such that the bottom panel 16 and the lower portions of the side panels 14 are in the chamber 20. Sidewalls 21 of the base 11 define the sides of the chamber 20. Furthermore, as depicted in FIG. 2, when the container 10 is disassembled (e.g., the panels 14, 15, 16 are decoupled from each other and no longer form the container), the chamber 20 advantageously receives the panels 14, 15, 16. That is, when the container 10 is disassembled or collapsed, the panels 14, 15, 16 are advantageously positioned in the chamber 20 in a stacked configuration (see FIG. 2). Accordingly, the panels 14, 15, 16 can be easily stored in the base 11. Optionally, the base 11 rests on a pedestal 8 having fork-receiving openings 9 or a convention pallet (not shown). Thus, the base 11 and the container 10 (either assembled or disassembled) is easily transported on the pedestal 8. Note that in certain examples, the base panel 16 is excluded and the channels 12 are in the base 11.

Figure 3:
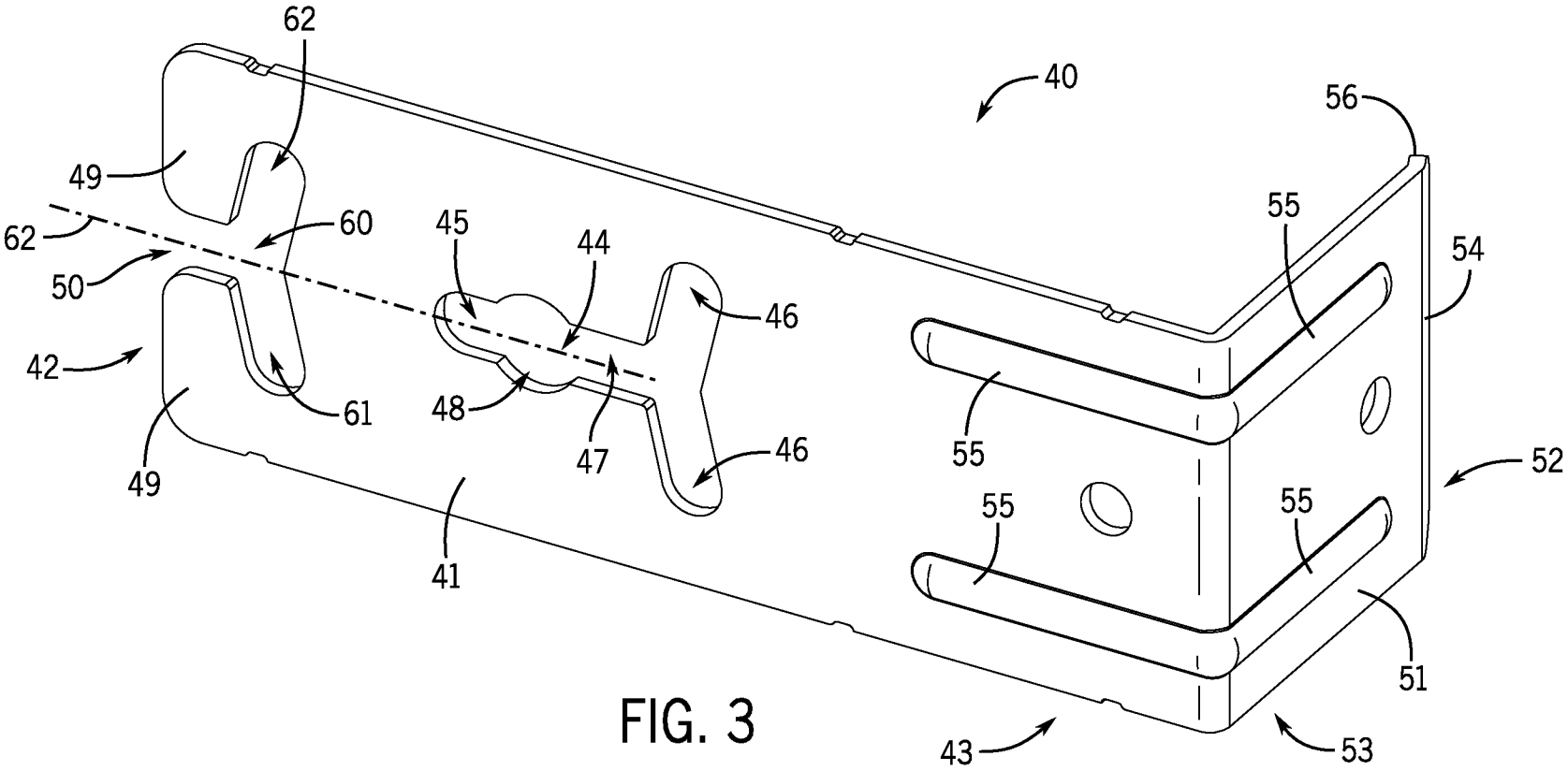
FIG. 3 is a perspective view of an example bracket according to the present disclosure.

As noted above, a bracket 40 is selectively coupled to each mounting plate 30 on the side panels 14, to thereby prevent movement of adjacent side panels 14 (described further herein). Referring now to FIG. 3, the bracket 40 is depicted in greater detail. The bracket 40 has a first arm 41 and a second arm 51 that is fixedly coupled to the first arm 41 such that the first arm 41 extends transverse to the second arm 51. The first arm 41 has a free first end 42 and an opposite second end 43 that is coupled to a second end 53 of the second arm 51. The second arm 51 also has a free first end 52 with an end portion 54 that extends transverse to the remaining portion of the second arm 51. Thus, the end portion 54 has an edge 56 that is configured to engage the exterior surface of a side panel 14 when the bracket 40 is coupled to the mounting plate 30. The second arm 51 includes stiffening elements 55 (e.g., welds, recessed channels such that the material on second arm 51 opposite the channel "bulges" outwardly) that stiffen the second arm 51 and prevent bending of the second arm 51. The first arm 41 also includes stiffening elements 55 that stiffen the first arm 41 and prevent bending of the first arm 41. Certain stiffening elements 55 of the first arm 41 and the second arm 51 are contiguous with each other such that these stiffening elements 55 prevent inadvertent bending of the first arm 41 relative to the second arm 51.

The first arm 41 has a first slot 44 and a second slot 60 that is spaced apart from the first slot 44. The first slot 44 has a head 45, a pair of opposing legs 46, and a body 47 that extends between the head 45 and the legs 46. The body 47 has an enlarged section 48 through which the pinhead 35 of the first pin 31 passes. That is, the width or diameter of the enlarged section 48 is greater than or equal to the width or diameter of the pinhead 35 of the first pin 31. The width of the other sections of the body 47, the head 45, and the legs 46 is less than the width or diameter of the pinhead 35 of the first pin 31. Thus, the pinhead 35 of the first pin 31 does not pass through the other sections of the body 47, the head 45, and the legs 46 and the pinhead 35 only passes through the enlarged section 48 (described further herein). Each leg 46 extends transverse to the body 47 and an angle is formed between the body 47 and each leg 46.

The second slot 60 is at the first end 42 of the first arm 41 such that the first end 42 of the first arm 41 has an opening 50 and two opposing prongs 49. Thus, the second pin 32 can pass between the prongs 49 into the second slot 60. The second slot 60 has a pair of opposing legs 61. Note that the width of the second slot 60 is less than the width or diameter of the pinhead 35 of the second pin 32. Thus, the second pin 31 only passes into or out of the second slot 60 when the bracket 40 is moved such that the second pin 31 is moved between the prongs 49. Each leg 61 extends away from each other and transverse to an axis 62. An angle is defined between the axis 62 and each leg 61. In certain examples, the angle defined between the axis 62 and one of the legs 61 is equal to the angle defined between the body 47 and one of the legs 46. In certain examples, the one leg 46 of the first slot 44 extending in the same direction as one leg 61 of the second slot 60. Note that the first arm 41 extends along the axis 62

FIGS. 4-15 depict an example sequence for coupling the bracket 40 to the mounting plate 30 that is on one of the side panels 14. Accordingly, as noted above, the bracket 40 prevents an adjacent side panel 14' from moving relative to the side panel 14 on which the mounting plate 30 is coupled. A person of ordinary skill in the art will recognize that the steps noted below may be combined with other steps. In certain examples, the side panels 14, 14' abut each other.

FIG. 4 depicts the one side panel 14 adjacent to another side panel 14'. The bracket 40 is spaced apart from the mounting plate 30 such that the enlarged section 48 of the first slot 44 is aligned with the first pin 31. The operator moves the bracket 40 in a fourth direction (see arrow D) toward the mounting plate 30 such that the first pin 31 passes through the enlarged section 48 of the first slot 44.

Figure 5:
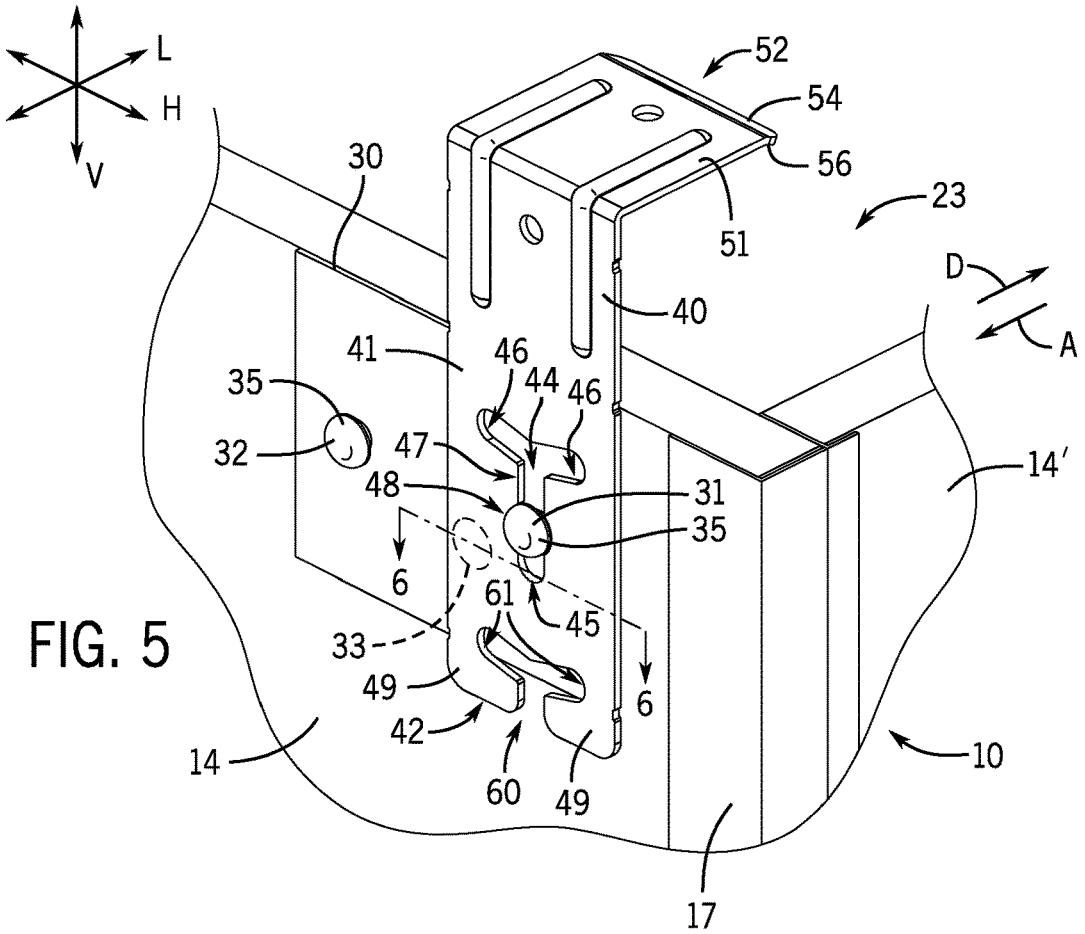
Figure 6:
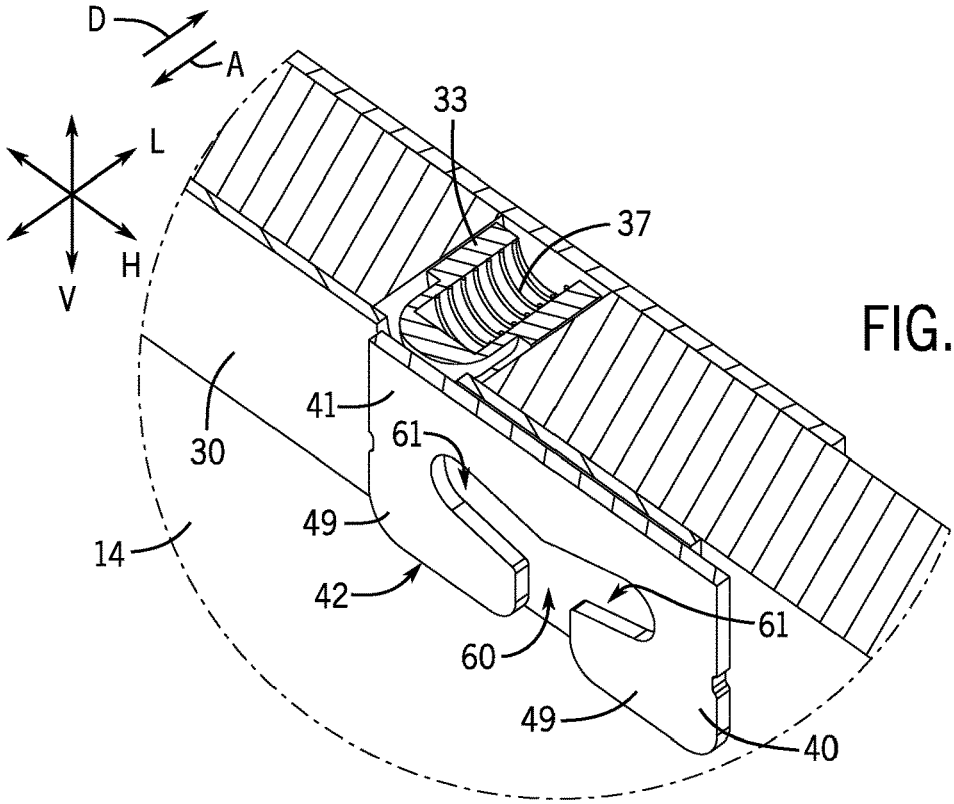

Referring to FIGS. 5-6, as the first pin 31 passes through the enlarged section 48 of the first slot 44, the bracket 40 acts on and moves the detent 33 in the fourth direction (see arrow D). That is, the bracket 40 forces the detent 33 in the fourth direction (see arrow D) against a spring force exerted by a spring 37 (FIG. 6) that normally biases the detent 33 in a first direction (see arrow A). Thus, the spring 37 is compressed as the detent 33 is moved in the fourth direction (see arrow D). Note that the detent 33 is depicted in dashed lines on FIG. 5.

Figure 7:
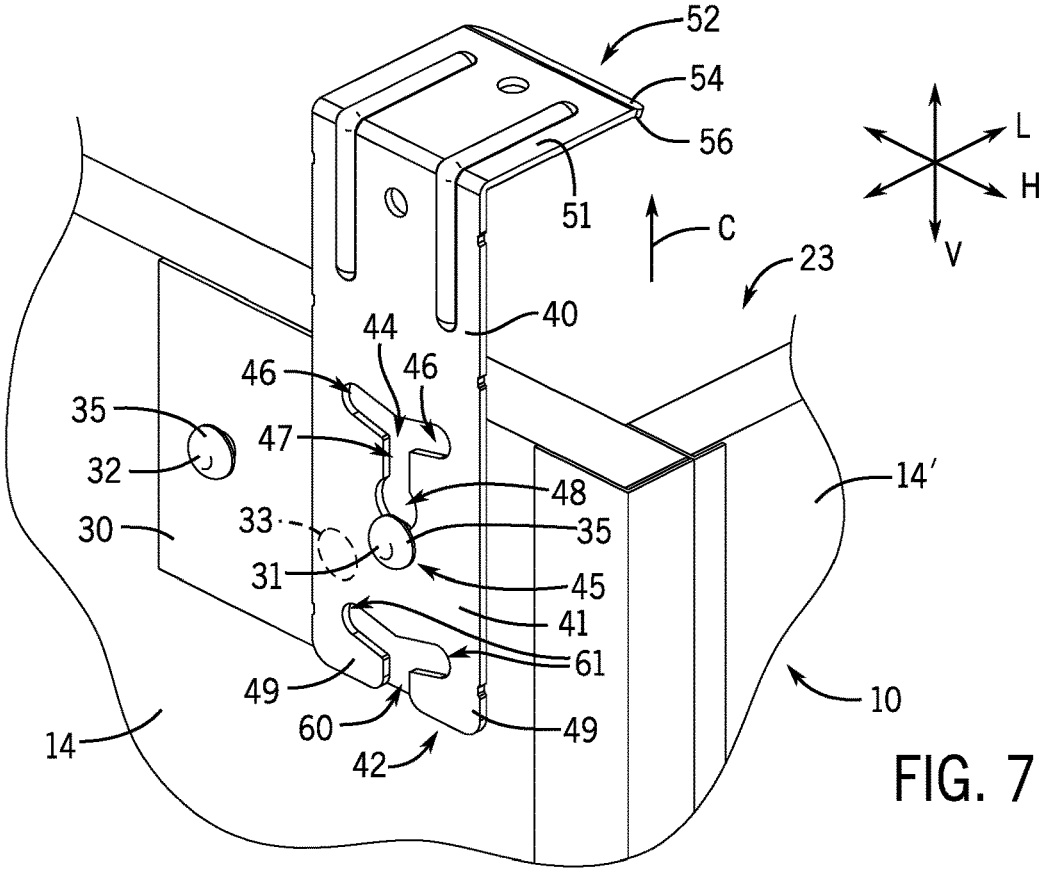

Referring to FIG. 7, after the first pin 31 passes through the enlarged section 48 of the first slot 44, the operator upwardly slides the bracket 40 in the third direction (see arrow C) such that the bracket 40 slides along the first pin 31 until the first pin 31 is at the head 45. Note that the pinhead 35 of the first pin 31 slides along the exterior surface of the bracket 40 while the shaft 36 (FIG. 12) of the first pin 31 slides in the first slot 44. Thus, the pinhead 35 prevents the bracket 40 from moving the first direction (see arrow A) away from the side panel 14. Note that the bracket 40 continues to act on the detent 33 as described above while the operator upwardly slides the bracket 40 in the third direction (see arrow C).

Figure 8:
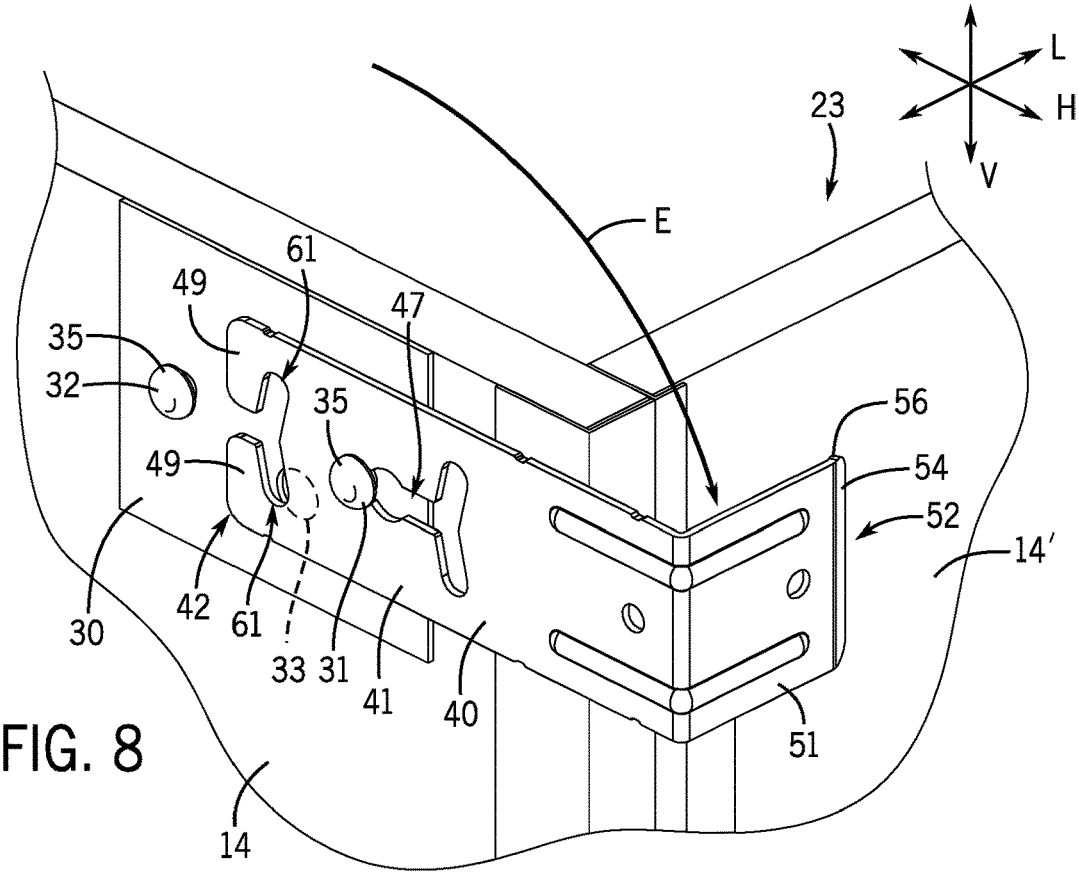

FIG. 8 depicts the operator pivoting the bracket 40 about the first pin 31 in a first pivot direction (see arrow E; e.g., clockwise direction) such that the second arm 51 of the bracket 40 is along the adjacent side panel 14'. Note that the bracket 40 continues to act on the detent 33 as described above while the operator pivots the bracket 40.

Figure 9:
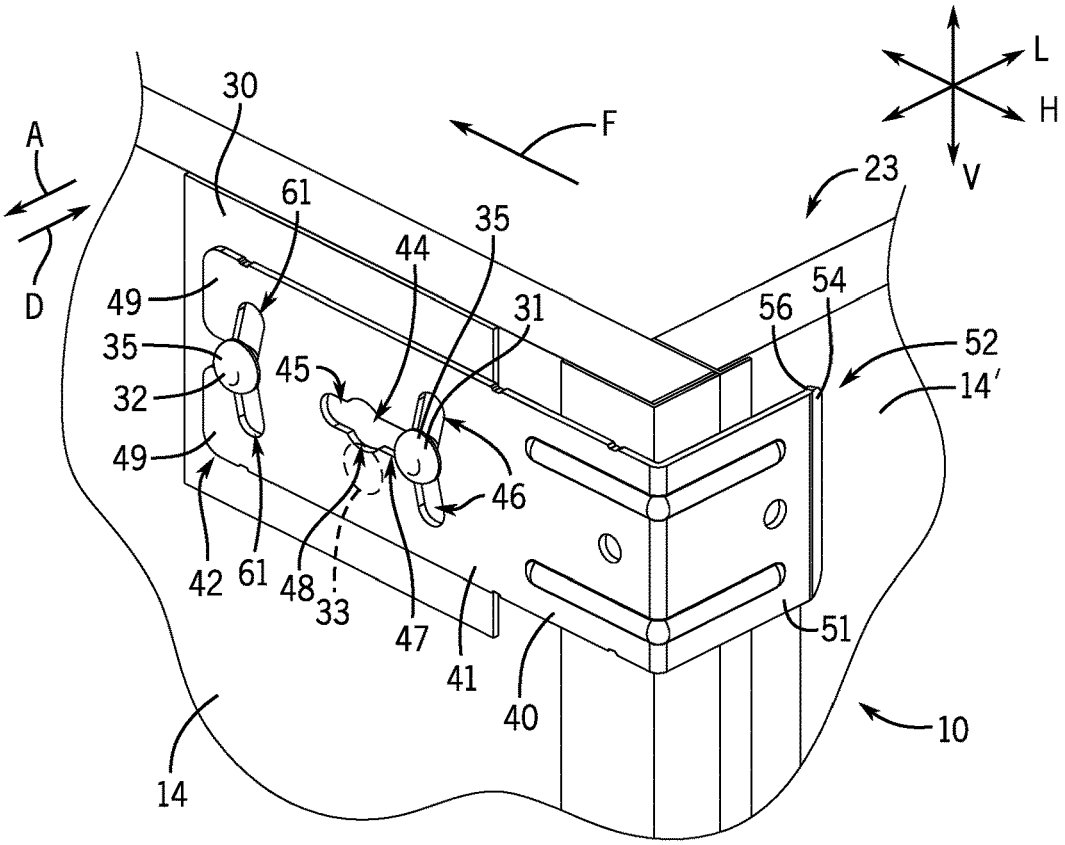

The operator then slides the bracket 40 in a fifth direction (see arrow F), as depicted in FIG. 9, until the second pin 32 is in the second slot 60, the first pin 31 is near the legs 46 of the first slot 44, and the second arm 51 of the bracket 40 is along the adjacent side panel 14'. In certain examples, the edge 56 of the second arm 51 contacts the exterior surface of the adjacent side panel 14'. Note that the pinhead 35 of the second pin 32 is along the surface of the bracket 40 while the shaft 36 (FIG. 12) of the second pin 32 is in the second slot 60. Thus, the pinhead 35 of the second pin 32 also prevents the bracket 40 from moving in the first direction (see arrow A) away from the side panel 14 (e.g., the pinheads 35 of the first pin 31 and the second pin 32 retain the bracket 40 on the panel 14). Note that the bracket 40 continues to act on the detent 33 as described above while the operator slides the bracket 40 in the fifth direction (see arrow F).

Figure 10:
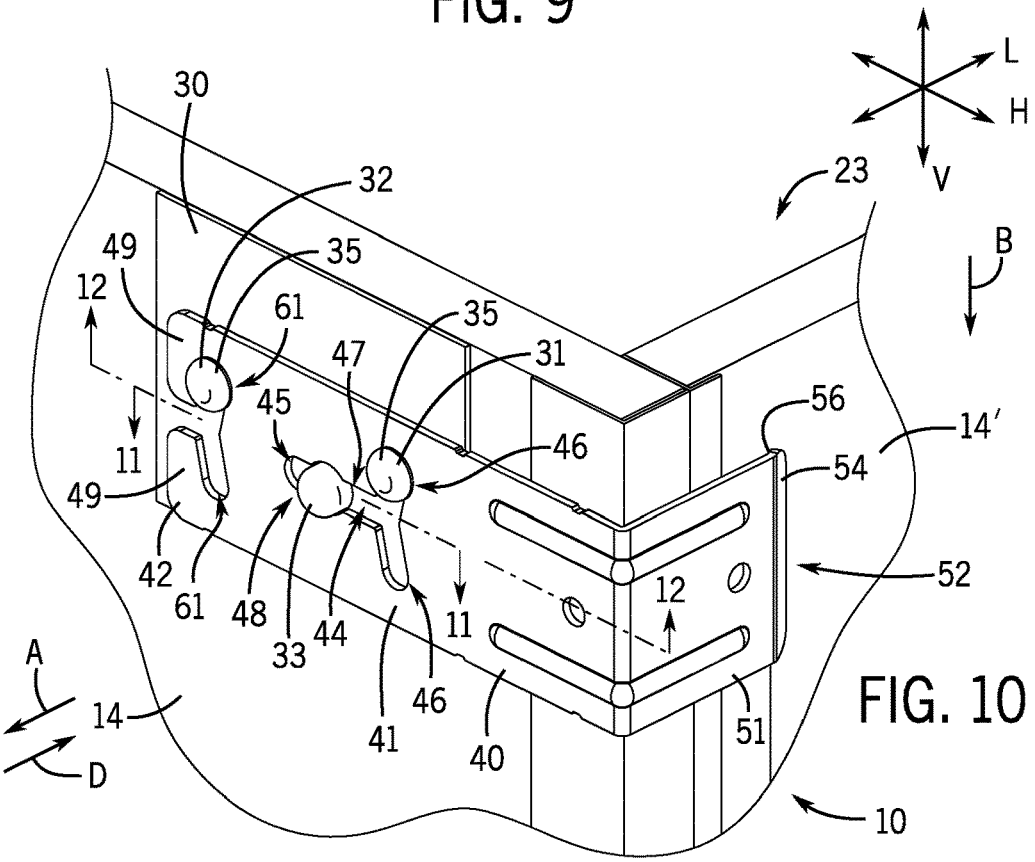
Figure 12:
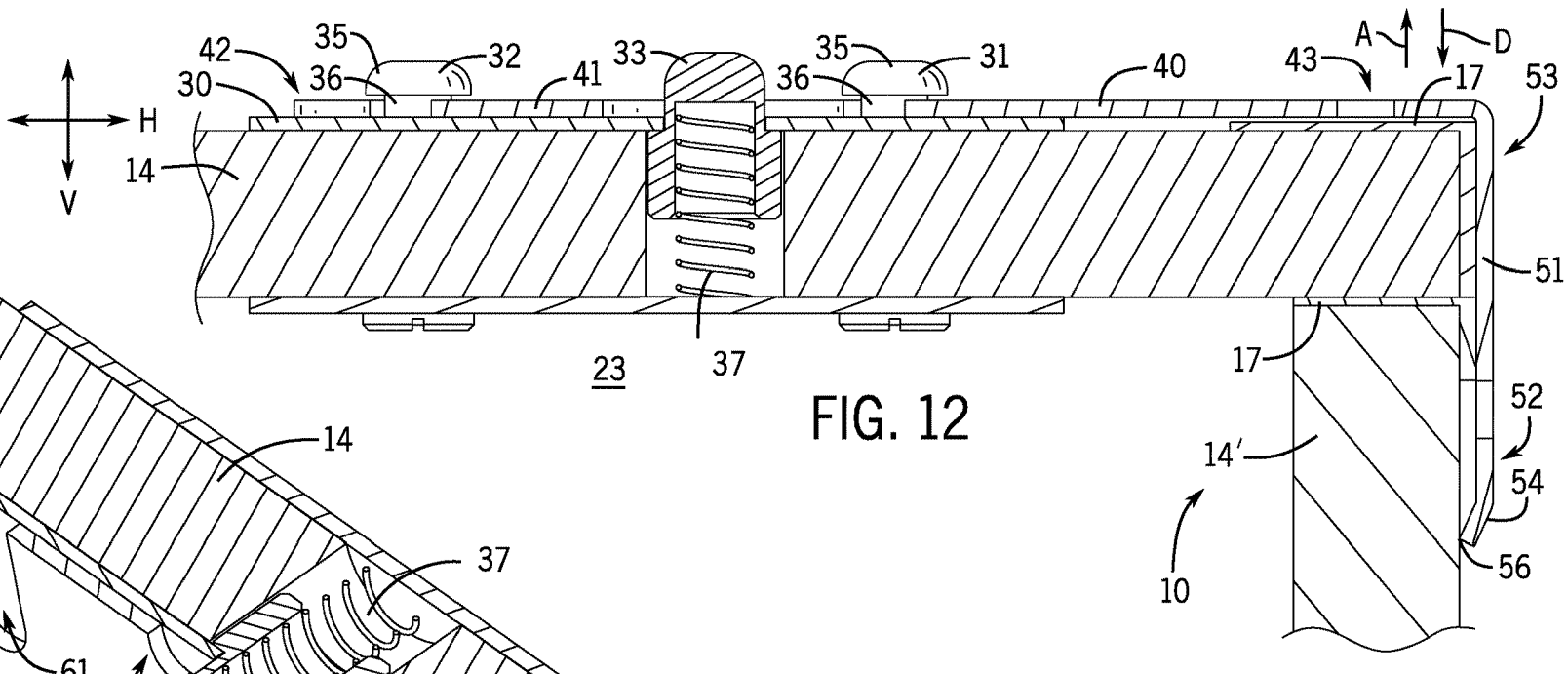
Figure 11:
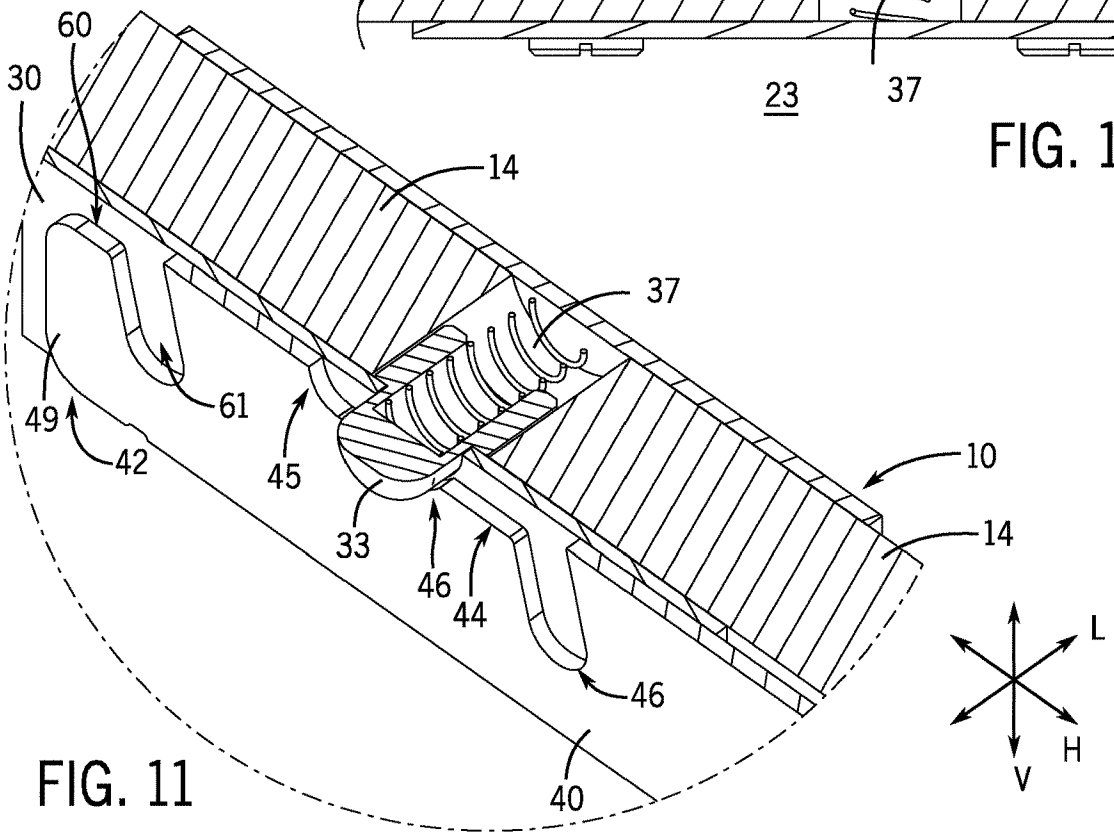

Referring now to FIGS. 10-12, the operator completes the coupling sequence (e.g., to fully secure or lock the bracket 40 into position on the mounting bracket 40) by sliding the bracket 40 generally downwardly (e.g., see second direction indicated by arrow B) such that the first pin 31 is in one of the legs 46 and the second pin 32 is in one of the legs 61. As the operator slides the bracket 40, the detent 33 is moved by the spring 37 (FIG. 12) in the first direction (see arrow A) such that the detent 33 extends through the enlarged section 48 of the first slot 44. As noted above, the detent 33 is offset from the pins 31, 32 (e.g., the detent 33 is vertically offset from the pins 31, 32) and accordingly, the bracket 40 is fixed in place on the mounting bracket 40. Thus, the second arm 51 of the bracket 40 is also fixed relative to the adjacent side panel 14' and thus, the bracket 40 creates a braced connection between the side panel 14 and the adjacent side panel 14' such that the bracket prevents the side panels 14, 14' from moving relative to each other.

The operator decouples the bracket 40 from the mounting bracket 40 (such as when the container 10 is to be disassembled or collapsed) by pressing the detent 33 in the fourth direction (see arrow D on FIG. 10) against the spring force applied by the spring 37 to the detent 33. Accordingly, the operator can then move (e.g., slide, pivot) the bracket 40 in different directions to decouple the bracket 40 from the mounting plate 30. Note that a person of ordinary skill in the art will recognize that the directions the operator must moves the bracket 40 to decouple to the bracket 40 from the mounting plate 30 are generally opposite the directions noted above with respect to the example coupling sequence for coupling the bracket 40 to the mounting plate 30.

Note that the legs 46, 61 of the slots 44, 60, respectively, are advantageously arranged such that the bracket 40 can be used on any side panel 14 of the container. For instance, FIGS. 4-12 depict the bracket 40 on a right side of the container 10. However, the bracket 40 could be "flipped" and used on the opposite, left side of the container 10.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A container comprising:

a first panel with a detent and a pin extending therefrom;

a second panel that extends transverse to the first panel; and a bracket removably coupled to the first panel via engagement with the detent and the pin such that the bracket engages the second panel to prevent movement of the second panel relative to the first panel;

wherein the detent is selectively depressed to thereby decouple the bracket from the first panel.

2. The container according to claim 1, wherein the bracket has a first arm coupled to the first panel and a second arm that extends transvers to the first arm along the second panel.

3. The container according to claim 1, wherein the second arm prevents movement of the second panel relative to the first panel in a first direction.

4. The container according to claim 3, further comprising a channel that prevents the movement of the second panel relative to the first panel in a second direction opposite the first direction.

5. The container according to claim 4, further comprising a base panel that supports the second panel, the base panel having a support member that defines the channel.

6. The container according to claim 2, wherein the first arm has a slot in which the pin and the detent are positioned.

7. The container according to claim 6, wherein the slot has an enlarged section through which the pin passes as the bracket is coupled to the first panel, and wherein when the bracket is coupled to the first panel, the detent is positioned in the enlarged section.

8. The container according to claim 6, wherein the slot has a leg in which the pin is positioned, opposite head, and an enlarged section between the leg and the head in which the detent is positioned.

9. The container according to claim 6, wherein the pin is a first pin, the slot is a first slot, and the first panel further comprises a second pin; and wherein the bracket has a second slot in which the second pin is positioned.

10. The container according to claim 9, wherein the first pin is aligned with the second pin and the detent is offset from the first pin and the second pin.

11. The container according to claim 9, wherein the first slot is spaced apart from the second slot.

12. The container according to claim 9, wherein the first slot has an enlarged section through which the first pin passes as the bracket is coupled to the first panel, and wherein when the bracket is coupled to the first panel, the detent is positioned in the enlarged section.

13. The container according to claim 9, wherein the first arm has a first end, and wherein the second slot extends to the first end such that the first end of the first arm has an opening between two prongs.

14. The container according to claim 9, wherein the first slot has a leg in which the first pin is positioned and the second slot has a leg in which the second pin is positioned, and wherein the leg of the first slot extends in the same direction as the leg of the second slot.

15. The container according to claim 1, wherein the detent is spring-biased in a direction away from the first panel.

16. The container according to claim 1, wherein the detent prevents movement of the bracket relative to the first pin.

17. A container comprising:

a first panel with a detent, a first pin, and a second pin extending therefrom;

a second panel that extends transverse to the first panel; and a bracket removably coupled to the first panel via engagement with the detent, the first pin, and the second pin such that a first arm of the bracket is coupled to the first panel and a second arm of the bracket extends along the second panel to thereby prevent movement of the second panel relative to the first panel;

wherein the detent is selectively depressed to thereby decouple the bracket from the first panel.

18. The container according to claim 17, wherein the first arm has a first slot in which the pin and the detent are positioned and a second slot in which the second pin is positioned, and wherein the first slot is spaced apart from the second slot.

19. The container according to claim 17, wherein the first slot has an enlarged section through which the first pin passes as the bracket is coupled to the first panel, and wherein when the bracket is coupled to the first panel, the detent is positioned in the enlarged section.

20. A method for assembling a container, the method comprising:

positioning a first panel adjacent to the second panel, wherein the first panel has a pin and a detent;

positioning a bracket with a slot along the first panel such that the pin is in the slot and the bracket depresses the detent; and moving the bracket relative to the first panel such that the pin is in a leg of the slot and the detent automatically extends into the slot such that the bracket is fixed relative to the first panel.

21. The method according to claim 20, further comprising depressing the detent and moving the bracket to thereby decouple the bracket from the first panel.

* * * * *